US007237351B1

(12) United States Patent
Fehring

(10) Patent No.: US 7,237,351 B1
(45) Date of Patent: Jul. 3, 2007

(54) CHANGEABLE DISPLAY SIGN SYSTEM

(76) Inventor: Robert G. Fehring, 15 The Helm, East Islip, NY (US) 11730

( * ) Notice: Subject to any disclaimer, the term of this patent is extended or adjusted under 35 U.S.C. 154(b) by 32 days.

(21) Appl. No.: 11/409,745

(22) Filed: Apr. 24, 2006

(51) Int. Cl.
*G09F 7/22* (2006.01)

(52) U.S. Cl. ..... 40/611.01; 40/617

(58) Field of Classification Search ..... 40/658, 40/617, 611.01; 248/475.1, 489, 490
See application file for complete search history.

(56) References Cited

U.S. PATENT DOCUMENTS 1,779,190 A 10/1930 Send
3,883,967 A 5/1975 Barnes
4,553,345 A 11/1985 Bercier et al.
4,564,165 A * 1/1986 Grant et al. ..... 248/343
4,882,864 A * 11/1989 Selwyn-Smith ..... 40/359
5,357,701 A 10/1994 Grate
5,367,800 A 11/1994 Nelson
5,381,991 A * 1/1995 Stocker ..... 248/206.5
5,542,202 A 8/1996 Brugger
5,704,147 A 1/1998 Rellinger
5,832,643 A 11/1998 Delaquila et al.
5,870,845 A * 2/1999 Ruderman et al. ..... 40/601
5,962,109 A 10/1999 Schwietz
6,131,747 A * 10/2000 Kin ..... 211/45

* cited by examiner

*Primary Examiner*—Cassandra Davis
(74) *Attorney, Agent, or Firm*—Richard L. Miller

(57) ABSTRACT

A changeable display sign system which comprises a track component having a mechanism for securing track component horizontally to a support surface, a plurality of indicia panels and a mechanism for suspending the indicia panels in a removable manner from the track component, wherein the indicia panels will hang down from the track component to be viewed.

15 Claims, 2 Drawing Sheets

CHANGEABLE DISPLAY SIGN SYSTEM

CROSS REFERENCE TO RELATED APPLICATIONS

The instant application contains subject matter disclosed in applicant's Disclosure Document No. 588720 filed on Oct. 27, 2005, and as such, it is respectfully requested in a separate paper attached herewith that this Disclosure Document be relied upon and remain a permanent part of the file history during the prosecution of the instant application and during any subsequent action thereof.

BACKGROUND OF THE INVENTION

1. Field of the Invention

The present invention relates to a display sign, and more particularly, a changeable display sign system.

2. Description of the Prior Art

Numerous innovations for display signs have been provided in the prior art that will be described. Even though these innovations may be suitable for the specific individual purposes to which they address, however, they differ from the present invention.

A FIRST EXAMPLE, U.S. Pat. No. 1,779,190, Issued on Oct. 21, 1930, to Send teaches a display sign comprising a supporting means, upwardly facing channel members secured thereto in spaced and parallel relation, a sign character having its lower edge receivable in the lower channel and its upper edge receivable beneath the upper channel, and a downwardly facing retaining channel having one side receivable in the upper channel and its other side adapted to overlap the upper edge of the sign character.

A SECOND EXAMPLE, U.S. Pat. No. 3,883,967, Issued on May 20, 1975, to Barnes teaches a framed backing panel with opposed, vertically spaced groove means which respectively receive the upper and lower edges of character plates. The distance between the bases of the upper and lower groove means is sufficiently greater than the height of the character plates, that when any character plate is raised to abut the base of the upper groove, the lower edge of that character plate will clear the lip of the lower groove, whereupon the character plate may be removed from the sign. To prevent unauthorized removal of character plates, an unobtrusive locking strip is longitudinally removably disposed in the upper groove between the base and the upper edges of the character plates. Means may be provided to prevent removal of the locking strip. The panel frame is preferably T-slotted to provide a convenient fastener mount for mounting the sign.

A THIRD EXAMPLE, U.S. Pat. No. 4,553,345, Issued on Nov. 19, 1985, to Bercier et al. teaches a display letter mounting arrangement for use in an open face sign having a flat forward, or display, surface. Each letter, or alphanumeric character, is provided on an individual flat panel which is inserted between generally horizontally oriented, parallel, upper and lower tracks. A high contrast, or illuminated, background screen is provided aft of the planar arrangement of letter panels which are positioned immediately adjacent one another. Each panel includes an opaque partition secured to a lateral edge of the panel along the length thereof so as to be positioned between immediately adjacent panels on the sign in an overlapping manner. Each partition, or inter-panel strip, has a cross section in the form of an "h", with the recessed portion thereof securely attached to the lateral edge of a panel permitting the extended portion of the partition to engage and overlap the proximal edge portion of an immediately adjacent panel. The partition eliminates inter-panel light leaks and provides for more stable letter mounting. The arrangement of the present invention is particularly adapted for reverse-type letters in combination with an illuminated, or high contrast, background.

A FOURTH EXAMPLE, U.S. Pat. No. 5,357,701, Issued on Oct. 25, 1994, to Grate teaches an enlarged figure panel for attachment to an attraction board that has a planar panel which is adapted to fit over the outer surfaces of the rails defining the channels of the attraction board. A plurality of offset flanges which extend parallel to the surface of the panel are adapted to fit under the upper and lower lips of the tracks of at least one channel of the attraction board for attaching the figure board thereto. A U-shaped spring or a tab is also provided to prevent the figure panel from being blown out of a track of an attraction board by wind.

A FIFTH EXAMPLE, U.S. Pat. No. 5,367,800, Issued on Nov. 29, 1994, to Nelson teaches an Interchangeable display system that includes a mounting for a display element, the mounting includes a support backing and upper, center and lower face panels mounted to the support backing and spaced forwardly of the support backing with two elongated slots extending lengthwise between the respective face display elements and which cooperates with the upper slot, and a lower mounting hook on the back of the display element cooperates with the lower slot so that the two hooks retain the display element and can slide along the respective slots to assemble and disassemble the display element in position in front of the mounting. The display element itself may have face panels separated by a slot so that a superimposed display element provided with a mounting hook on the back thereof can be mounted in front of the display element.

A SIXTH EXAMPLE, U.S. Pat. No. 5,542,202, Issued on Aug. 6, 1996, to Brugger teaches a changeable letter for signs as a part of an illuminated sign or copy board system which provides different appearances when the changeable letters are alternately backlit or frontlit. The letter, understood to include letters, symbols and numerals, includes a translucent plate and first, second or additional layers of opaque, indicia-defining material applied thereto. The second layer is preferably of a lighter color than the first layer, and when superposed thereon, presents the appearance of a lighter colored letter surrounded by a darker border. However, when the letter is backlit as it would appear at nighttime positioned on an illuminated sign, the letter presents a black or otherwise darkened appearance surrounded by the lighted portion of the sign.

A SEVENTH EXAMPLE, U.S. Pat. No. 5,704,147, Issued on Jan. 6, 1998, to Rellinger teaches a magnetic letter board assembly having a magnetic letter board and removably magnetically secured magnetic graphic indicia bodies, wherein the front surface of the board has a pair of inwardly converging walls and a wall bridging the inwardly converging walls, and the graphic indicia bodies have a recess formed with a pair of inwardly converging walls and a bottom wall bridging the inwardly converging walls conforming to the walls and bridging wall of the board, for cooperative removable securement of the indicia bodies on the board. The graphic indicia bodies comprises of magnetic flexible integrally formed graphic indicia and background members formed to fit the board.

AN EIGHTH EXAMPLE, U.S. Pat. No. 5,832,643, Issued on Nov. 10, 1998, to Delaquila et al. teaches a display sign that includes a translucent, planar back panel attached to a front, open portion of a generally rectangular housing which contains a light source. Disposed on a front surface of the back panel in a vertically spaced manner are a first plurality of parallel, linear, horizontally aligned tracks, or rails. The display sign further includes a plurality of front panels each having a respective second plurality of horizontally aligned, vertically spaced, linear tracks on an aft surface thereon. Each of the second tracks is adapted to engage a respective one of the first tracks on the front of the sign's back panel for securely and removably attaching the front panels to the back panel. The depth of each of the second tracks, or the extent each of the second tracks extends outwardly from the aft surface of a front panel, is the same for all tracks on a given front panel, with the depth of the tracks on adjacent panels being different. This difference in the depth of the support tracks on adjacent front panels allows the front panels to be positioned in an edge-overlapping manner on the back panel where the overlapping portions of an adjacent pair of front panels prevent light leaks between the panels. The alphanumeric or graphic display on the front panels may be disposed over the sets of interlocking tracks and may extend to the edges of the front panels to provide a continuous full view image on the front of the sign.

It is apparent now that numerous innovations for display signs have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a changeable display sign system that avoids the disadvantages of the prior art.

ANOTHER OBJECT of the present invention is to provide a changeable display sign system that is simple and inexpensive to manufacture.

STILL ANOTHER OBJECT of the present invention is to provide a changeable display system that is simple to use.

BRIEFLY STATED, STILL YET ANOTHER OBJECT of the present invention is to provide a changeable display sign system which comprises a track component; means for securing the track component horizontally to a support surface; a plurality of indicia panels; and means for suspending the indicia panels in a removable manner from the track components, wherein the indicia panels will hang down from the track component to be viewed.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

Figure 1:
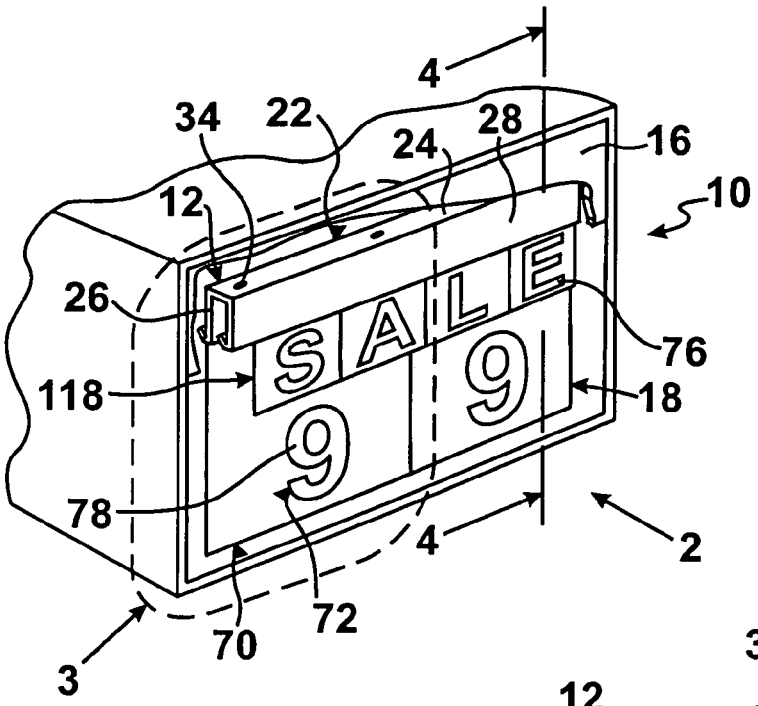
FIG. 1 is a diagrammatic perspective view, with parts broken away, showing the present invention in use.
Figure 3:
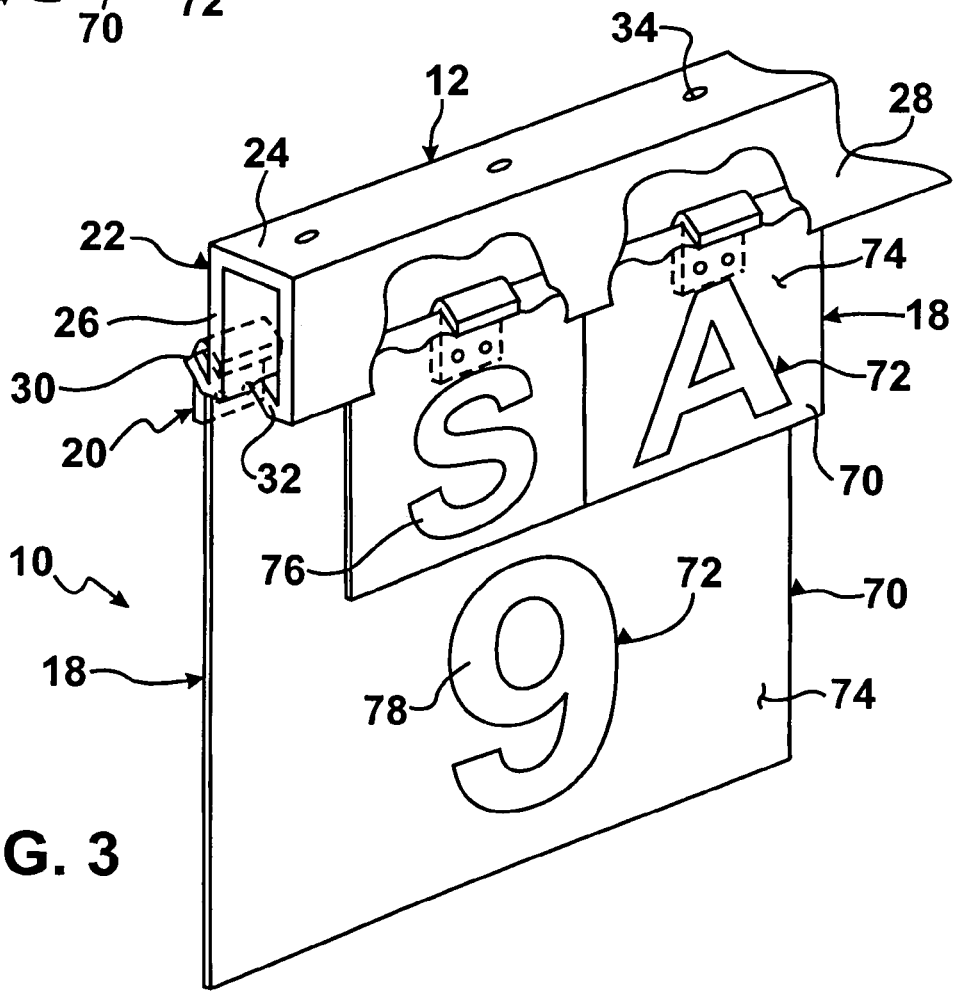
FIG. 3 is an enlarged diagrammatic perspective view, with parts broken away, of the area enclosed by the dotted curved indicated by arrow 2 in FIG. 1, showing a portion of the present invention.

10 changeable display sign system
12 first track component of changeable display sign system 10
14 securing mechanism for track component 12
16 support surface
18 indicia panel of changeable display sign system 10
20 suspending structure of changeable display sign system 10
22 channel member for track component 12
24 top wall of channel member 22
26 first side wall of channel member 22
28 second side wall of channel member 22
30 first rail on the first side wall 26
32 second rail on the second side wall 28
34 aperture in top wall 24
36 fastener of securing mechanism 14
38 hook element of suspending structure 20
40 lower body portion of hook element 38
42 upper curved portion of hook element 38
44 attaching mechanism of suspending structure 20
46 rear surface of indicia panel 18
48 top edge of indicia panel 18
50 hole in lower body portion 40
52 aperture in indicia panel 18
54 connector of attaching mechanism 44
56 vertical flange on top wall 24 of channel member 22
58 aperture in vertical flange 56
60 fastener of securing mechanism 14
62 first horizontal flange on top wall 24 of channel member 22
64 second horizontal flange on top wall 24 of channel member 22
66 aperture in first horizontal flange 62 and second horizontal flange 64
68 fastener of securing mechanism 14
70 generally rectangular plate for indicia panel 18
72 character on indicia panel 18
74 front surface of generally rectangular plate 70
76 letter for character 72
78 number for character 72

DETAILED DESCRIPTION OF THE PREFERRED EMBODIMENT

Referring now to the figures, in which like numerals indicate like parts, and particularly to FIGS. 1, 2, 3, 4 and 5, which are a diagrammatic perspective view, with parts broken away, showing the present invention in use; a diagrammatic front elevational view of the present invention taken in the direction of arrow 2 in FIG. 1; an enlarged diagrammatic perspective view, with parts broken away, of the area enclosed by the dotted curved indicated by arrow 2 in FIG. 1, showing a portion of the present invention; an enlarged diagrammatic cross sectional view, with parts broken away, taken on line 4—4 in FIG. 1; and a diagrammatic exploded perspective view showing how hook elements on the indicia panels cooperate with a portion of a first embodiment of the track component, and as such, will be discussed with reference thereto.

The present invention is a changeable display sign system 10, which comprises a track component 12. A mechanism 14 is for securing the track component 12 horizontally to a support surface 16. A plurality of indicia panels 18 are also provided. A structure 20 is for suspending the indicia panels 18 in a removable manner from the track component 12, wherein the indicia panels 18 will hang down from the track component 12 to be viewed.

Figure 4:
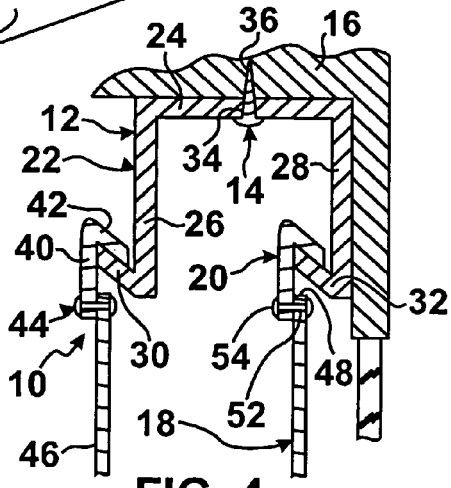
FIG. 4 is an enlarged diagrammatic cross sectional view, with parts broken away, taken on line 4—4 in FIG. 1.
Figure 2:
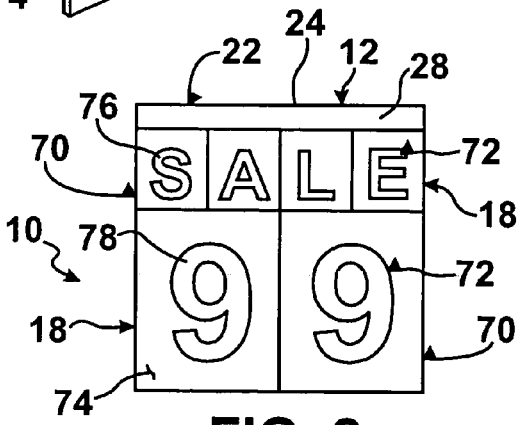
FIG. 2 is a diagrammatic front elevational view of the present invention taken in the direction of arrow 2 in FIG. 1.

The track component 12 is a channel member 22. The channel member 22 includes a top wall 24, a pair of side walls 26, 28 spaced apart and extending downwardly from opposite ends of the top wall and a pair of rails 30, 32. The first rail 30 is formed at an acute angle on a lower free end of the first side wall 26, while the second rail 32 is formed at an acute angle on a lower free end of the second side wall 28. The securing mechanism 14 consists of the top wall 24 of the channel member 22 having a plurality of spaced apart apertures 34 therealong and a plurality of fasteners 36. The fasteners 36 extend through the apertures 34 in the top wall 24 and into the support surface 16, as shown in FIG. 4.

Figure 5:
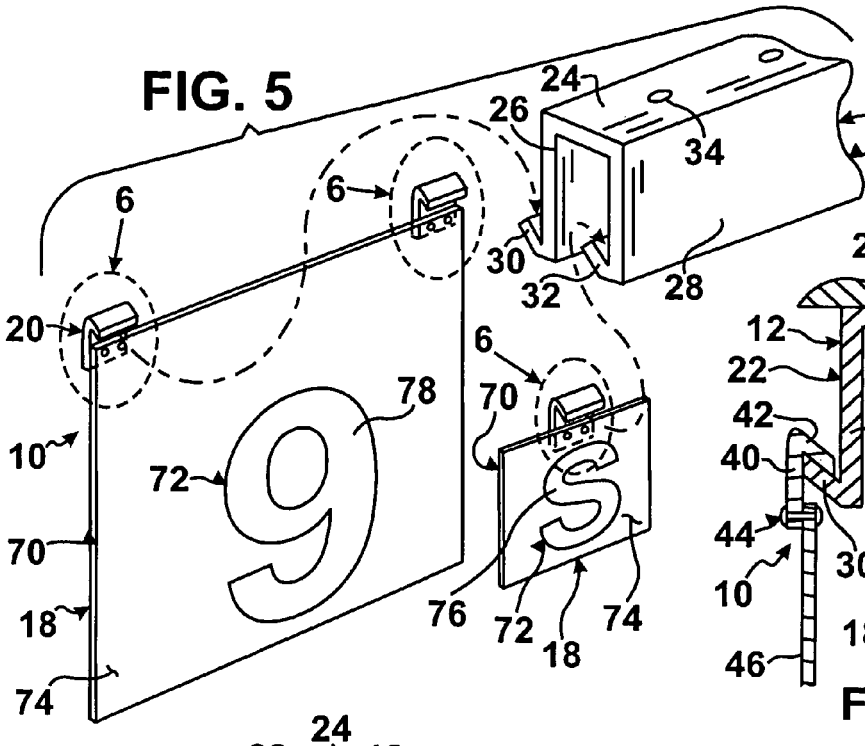
FIG. 5 is a diagrammatic exploded perspective view showing how hook elements on the indicia panels cooperate with a portion of a first embodiment of the track component.
Figure 6:
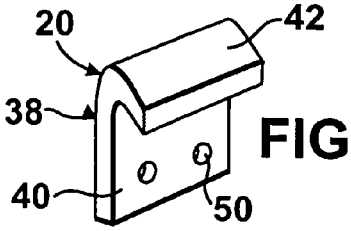
FIG. 6 is an enlarged diagrammatic perspective view, of the areas enclosed by the dotted curves indicated by arrows 6 in FIG. 5, showing a typical hook element in greater detail.

FIG. 6 is an enlarged diagrammatic perspective view, of the areas enclosed by the dotted curves indicated by arrows 6 in FIG. 5, showing a typical hook element in greater detail, and as such, will be discussed with reference thereto.

The suspending structure 20 includes at least one hook element 38 having a lower body portion 40 and an upper curved portion 42. A mechanism 44 is for attaching the lower body portion 40 of the at least one hook element 38 onto a rear surface 46 of one indicia panel 18 near a top edge 46. The upper curved portion 42 of the at least one hook element 38 can engage with one of the pair of rails 30, 32 of the channel member 22, as best seen in FIG. 4.

The attaching mechanism 44 consists of the at least one hook element 38 having at least one hole 50 through the lower body portion 40 thereof. The indicia panel 18 has at least one aperture 52 therethrough near the top edge 48. At least one connector 54 is provided. The at least one connector 54 extends through the at least one hole 50 in the lower body portion 40 of the at least one hook element 38 and into at least one aperture 52 in the indicia panel 18, to retain the lower body portion 40 of the at least one hook element 38 to the rear surface 46 of the indicia panel 18. The upper curved portion 42 of the at least one hook element 38 extends above the top edge 48 of the indicia panel 18.

Figure 7:
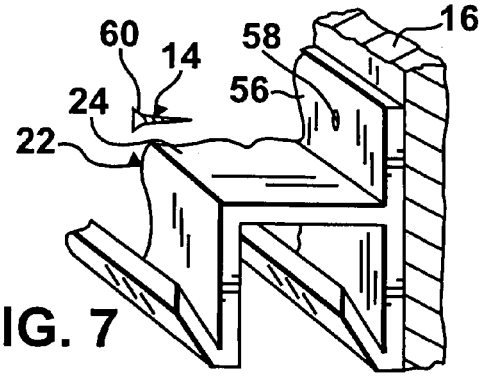
FIG. 7 is a diagrammatic perspective view, with parts broken away, of a second embodiment of the track component.

FIG. 7 is a diagrammatic perspective view, with parts broken away, of a second embodiment of the track component, and as such, will be discussed with reference thereto. The channel member 22 further includes a vertical flange 56 extending upwardly from one end of the top wall 24. The securing mechanism 14 includes the vertical flange 56 of the channel member having a plurality of spaced apart apertures 58 therealong. A plurality of fasteners 60 are provided. The fasteners 60 extend through the apertures 58 in the vertical flange 56 and into the support surface 16.

Figure 8:
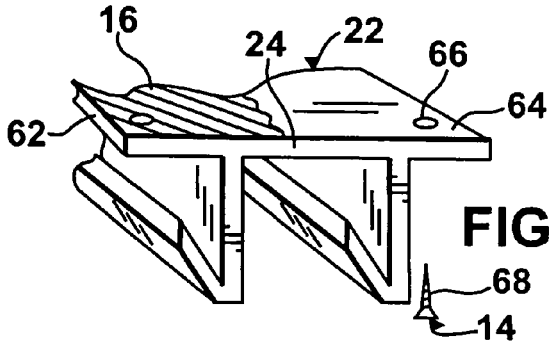
FIG. 8 is a diagrammatic perspective view, with parts broken away, of a third embodiment of the track component.

FIG. 8 is a diagrammatic perspective view, with parts broken away, of a third embodiment of the track component, and as such, will be discussed with reference thereto. The channel member 22 further includes a first horizontal flange 62 extending away from a first end of the top wall 24 and a second horizontal flange 64 extending away from a second end of the top wall 24.

The securing mechanism 14 consists of the first horizontal flange 62 and the second horizontal flange 64, each having a plurality of spaced apart apertures 66 therealong. A plurality of fasteners 68 are provided. The fasteners 68 extend through the apertures 66 in the first horizontal flange 62, apertures 56 in the second horizontal flange 64 and into the support surface 16.

As shown in FIGS. 1, 2, 3 and 5, some of the indicia panels 18 are large, while some of the indicia panels 18 are small. The at least one hook element 38 on the large indicia panels 18 can engage with the first rail 30 on the first side wall 26 of the channel member 22, while the at least one hook element 38 on the small indicia panels 18 can engage with the second rail 32 of the channel member 22 in front of the large indicia panels 18 to be viewed together.

Each indicia panel 18 includes a generally rectangular plate 70 and a character 72 imprinted upon a front surface 74 of the generally rectangular plate 70. The character 72 can be a letter 76, a number 78 or a symbol or a picture (both not shown).

It will be understood that each of the elements described above, or two or more together, may also find a useful application in other types of constructions differing from the types described above.

While the invention has been illustrated and described as embodiments of a changeable display sign system, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A changeable display sign system which comprises:

a) track component;

b) means for securing said track component horizontally to a support surface;

c) a plurality of indicia panels;

d) means for suspending said indicia panels in a removable manner from said track component, wherein said indicia panels will hang down from said track component to be viewed, wherein said track component is a channel member, wherein said channel member includes:

e) a top wall;

f) a pair of side walls spaced apart and extending downwardly from opposite ends of said top wall;

g) a pair of rails, wherein said first rail is formed at an acute angle on a lower free end of said first side wall, while said second rail is formed at an acute angle on a lower free end of said second side wall, wherein said suspending means includes:

h) at least one hook element having a lower body portion and an upper curved portion; and i) means for attaching said lower body portion of said at least one hook element onto a rear surface of one said indicia panel near a top edge, wherein said upper curved portion of said at least one hook element can engage with one of said pair of rails of said channel member, wherein said attaching means includes:

j) said at least one hook element having at least one hole through said lower body portion thereof;

k) said indicia panel having at least one aperture therethrough near said top edge; and l) at least one connector, wherein said at least one connector extends through said at least one hole in said lower body portion of said at least one hook element and into said at least one said aperture in said indicia panel to retain said lower body portion of said at least one hook element to said rear surface of said indicia panel, wherein said upper curved portion of said at least one hook element extends above said top edge of said indicia panel.

2. The changeable display sign system, as recited in claim 1, wherein said securing means includes:

a) said top wall of said channel member having a plurality of spaced apart apertures therealong; and b) a plurality of fasteners, wherein said fasteners extend through said apertures in said top wall and into the support surface.

3. The changeable display sign system as recited in claim 1, wherein said channel member further includes a vertical flange extending upwardly from one end of said top wall.

4. The changeable display sign system as recited in claim 3, wherein said securing means includes:

a) said vertical flange of said channel member having a plurality of spaced apart apertures therealong; and b) a plurality of fasteners, wherein said fasteners extend through said apertures in said vertical flange and into the support surface.

5. The changeable display sign system as recited in claim 1, wherein each said indicia panel includes:

a) a generally rectangular plate; and b) a character imprinted upon a front surface of said generally rectangular plate.

6. The changeable display sign system as recited in claim 5, wherein said character is a letter.

7. The changeable display sign system as recited in claim 5, wherein said character is a number.

8. The changeable display sign system as recited in claim 5, wherein said character is a symbol.

9. The changeable display sign system as recited in claim 5, wherein said character is a picture.

10. A changeable display sign system which comprises:

a) track component;

b) means for securing said track component horizontally to a support surface;

c) a plurality of indicia panels;

d) means for suspending said indicia panels in a removable manner from said track component, wherein said indicia panels will hang down from said track component to be viewed, wherein said track component is a channel member, wherein said channel member includes:

e) a top wall;

f) a pair of side walls spaced apart and extending downwardly from opposite ends of said top wall;

g) a pair of rails, wherein said first rail is formed at an acute angle on a lower free end of said first side wall, while said second rail is formed at an acute angle on a lower free end of said second side wall, wherein said channel member further includes:

h) a first horizontal flange extending away from a first end of said top wall;

i) a second horizontal flange extending away from a second end of said top wall, wherein said securing means includes:

j) said first horizontal flange and said second horizontal flange, each having a plurality of spaced apart apertures therealong; and k) a plurality of fasteners, wherein said fasteners extend through said apertures in said first horizontal flange, said apertures in said second horizontal flange and into the support surface.

11. The changeable display sign system as recited in claim 10, wherein said channel member further includes a vertical flange extending upwardly from one end of said top wall.

12. The changeable display sign system as recited in claim 11, wherein said securing means includes:

a) said vertical flange of said channel member having a plurality of spaced apart apertures therealong; and b) a plurality of fasteners, wherein said fasteners extend through said apertures in said vertical flange and into the support surface.

13. A changeable display sign system which comprises:

a) track component;

b) means for securing said track component horizontally to a support surface;

c) a plurality of indicia panels; and d) means for suspending said indicia panels in a removable manner from said track component, wherein said indicia panels will hang down from said track component to be viewed, wherein said track component is a channel member, wherein said channel member includes:

e) a top wall;

f) a pair of side walls spaced apart and extending downwardly from opposite ends of said top wall; and g) a pair of rails, wherein said first rail is formed at an acute angle on a lower free end of said first side wall, while said second rail is formed at an acute angle on a lower free end of said second side wall, wherein said suspending means includes:

h) at least one hook element having a lower body portion and an upper curved portion; and i) means for attaching said lower body portion of said at least one hook element onto a rear surface of one said indicia panel near a top edge, wherein said upper curved portion of said at least one hook element can engage with one of said pair of rails of said channel member, wherein some of said indicia panels are large, while some of said indicia panels are small, so that said at least one hook element on said large indicia panels can engage with said first rail of said channel member while said at least one hook element on said small indicia panels can engage with said second rail of said channel member in front of said large indicia panels to be viewed together.

14. The changeable display sign system as recited in claim 13, wherein said channel member further includes a vertical flange extending upwardly from one end of said top wall.

15. The changeable display sign system as recited in claim 14, wherein said securing means includes:

a) said vertical flange of said channel member having a plurality of spaced apart apertures therealong; and b) a plurality of fasteners, wherein said fasteners extend through said apertures in said vertical flange and into the support surface.

* * * * *